United States Patent [19]

Spica

[11] Patent Number: 4,964,247

[45] Date of Patent: Oct. 23, 1990

[54] GUTTER SCREENING AND FLUSHING SYSTEM

[75] Inventor: Joseph P. Spica, Livonia, Mich.

[73] Assignee: The 2500 Corporation, Farmington Hills, Mich.

[21] Appl. No.: 326,228

[22] Filed: Mar. 20, 1989

[51] Int. Cl.[5] ..... E04D 13/00

[52] U.S. Cl. ..... 52/12; 52/11

[58] Field of Search ..... 52/12, 11; 248/48.1, 248/48.2

[56] References Cited

U.S. PATENT DOCUMENTS

| | | | |
|---|---|---|---|
| 870,165 | 11/1907 | Hagler . | |
| 2,515,027 | 7/1950 | Walton | 108/30 |
| 2,569,568 | 10/1951 | Lipshaw | 52/12 X |
| 2,717,561 | 9/1955 | Bearden . | |
| 2,887,073 | 5/1959 | Thompson | 108/28 |
| 3,855,132 | 12/1974 | Dugan . | |
| 4,183,368 | 1/1980 | Husted . | |
| 4,607,465 | 8/1986 | Hoskins . | |

*Primary Examiner*—David A. Scherbel
*Assistant Examiner*—Creighton Smith
*Attorney, Agent, or Firm*—Dykema Gossett

[57] ABSTRACT

There is disclosed a gutter drain strip having a platform portion with a plurality of drain holes provided therein, and a pair of legs downwardly depending from said platform portion to provide for mounting of the gutter drain strip in a gutter. A gutter draining and flushing system using said gutter drain strip is also shown, where the legs thereof are severed at a predetermined desired position, permitting a portion of the gutter drain strip to be bent at a right angle and fit up against an end wall of the gutter to accept a hose for the purposes of flushing the gutter.

16 Claims, 2 Drawing Sheets

GUTTER SCREENING AND FLUSHING SYSTEM

BACKGROUND OF THE INVENTION

1. Field of the Invention:

The present invention relates to the use of gutters on buildings of all type to provide proper drainage from the roofs of said building, and more particularly to a gutter draining and flusing system for installation in such gutters.

2. Description of the Prior Art:

The prior art shows that prior patents in this area either deal with articles for screning gutters to prevent the need to flush out said gutters, or deal with flushing systems for flushing out unscreened gutters to remove the leaves and gravel which normally accumulate in the gutter. Before proceeding to prepare and file the present patent application, I caused a search to be made through the files of the U.S. Patent and Trademark Office to locate patents which might have a bearing on the patentability of my idea. The search located the following references:

| U.S. Pat. No. | Patentee | Year |
|---|---|---|
| 870,165 | J. D. Hagler, et al | Nov. 5, 1907 |
| 2,515,027 | A. Walton | July 11, 1950 |
| 2,717,501 | J. M. Bearden | Sept. 13, 1955 |
| 2,887,073 | W. G. Thompson | May 19, 1959 |
| 3,855,132 | W. P. Dugan | Dec. 17, 1974 |
| 4,183,368 | G. V. Husted | Jan. 15, 1980 |
| 4,607,465 | G. K. Hopkins | Aug. 26, 1986 |

A review of the above patents will show that Pat. Nos. 870,165; 2,515,027; 2,717,561; 3,855,132 and 4,607,465 are of the type dealing with the aforementioned devices for screening gutters to prevent the need for flushing, while Pat. Nos. 2,887,073 and 4,183,368 deal with the latter type of device, i.e. a gutter flushing system shown for use on unscreened gutters. None of the patents listed above, however, solve the problem of how to keep debris out of gutters to keep them working efficiently, while at the same time providing for the occasional flushing which is always needed no matter how well a gutter may be screened. Any of the screening devices, while they may keep leaves out of the gutter to one degree or another, still permit the passage of the fine gravel found on asphalt shingles and the like into the bottom of the gutter, which still requires that the gutter be flushed periodically, which then requires the cumbersome removal of the screening device.

On the other hand, the gutter flushing systems shown will be rendered ineffective because of the failure to provide some type of screening. It is believed such systems will not remove the heavy accumulation of leaves from the gutter which are normally found in the fall, thus requiring han removal of the leaves from the gutter before activating the flushing system. Nobody, until the present time, has thought to combine the gutter screen with the flushing system to solve these long-standing problems in the prior art. I, by careful analysis of the problems present in the gutter art, have provided a combination gutter screening and flushing system which is inexpensive to manufacture, and easily installed.

SUMMARY OF THE INVENTION

In order to prevent leaves from accumulating in a wet heavy decomposing layer in the bottom of a gutter, whose hand removal is required before any gutter flushing system can be effective, and to provide for a gutter flushing system which is effective in keeping leaves off the bottom of the gutter, and effectively flushing out roofing gravel which does find its way into the gutter, I have provided a combination gutter draining and screening system wherein a gutter drain strip is installed in the gutter in such a manner to have an elevated platform portion supported on a pair of downwardly depending legs to provide a drain channel at the bottom of the gutter to flush out roofing gravel, and at the same time elevate any portion of the gutter on which leaves may come to rest, allowing the water to drain thru the leaves into bottom of the gutter, leaving the leaves dry. Because the leaves are being suspended above the bottom of the wet gutter, they will remain dry and loosely layered, allowing water to drain thru and thus requiring fewer cleanings. The dry leaves may be easily removed by a common garden blower, brush, or by hand. A common garden hose can be inserted in a right angled portion of the gutter drain strip, which provides for a hose holding portion to retain the garden hose in position for sufficient length of time to wash all the roofing gravel out of the bottom of the gutter.

Thus, it is an object of the present invention to provide a combination gutter screening and flushing system which, simultaneosly, prevents accumulation of wet leaves in the gutter, and provides for flushing of roofing gravel out of the gutter.

A further object of the present invention is to provide a gutter screening and flushing system whereby leaves will not have to be removed from the gutter before the gutter can be flushed.

A still further object of the present invention is to provide for a gutter drain strip which is lightweight, and may be easily installed in the gutter as a part of my gutter draining and flusing system.

A still further object of the present invention is to provide a gutter drain strip which is light in weight and does not add appreciably to the weight of the gutter.

A further object of the present invention is to provide a combination gutter screening and flushing system of the foregoing nature which is simple in construction and inexpensive to manufacture.

Further objects and advantages of the present invention will be apparent from the following description and appended claims, reference being made to the accompanying drawings forming a part of this specification, wherein like reference characters designate corresponding parts in the several views.

It is to be understood that the present invention is not limited to the details of construction and arrangement of parts illustrated in the accompanying drawings, since the invention is capable of other embodiments, and of being practiced or carried out in various ways within the scope of the claims. Also, it is to be understood that the phrasology and terminology employed herein is for the purpose of description, and not of limitation.

Figure 1:
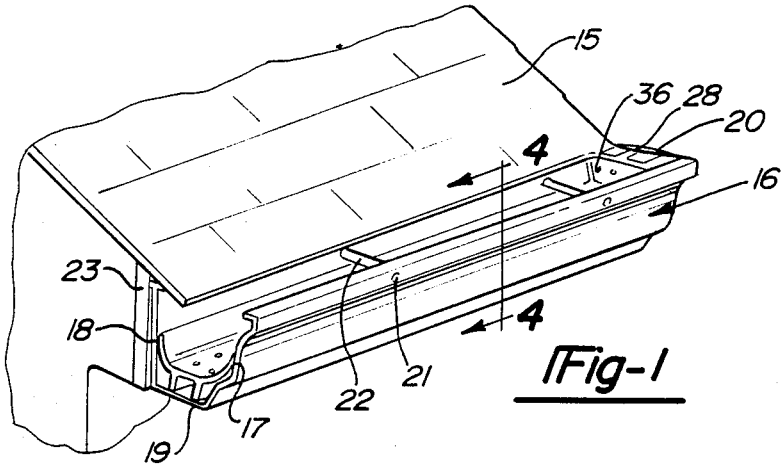
FIG. 1 is a cutaway perspective view of a construction embodying my combination gutter screening and flushing system.
Figure 2:
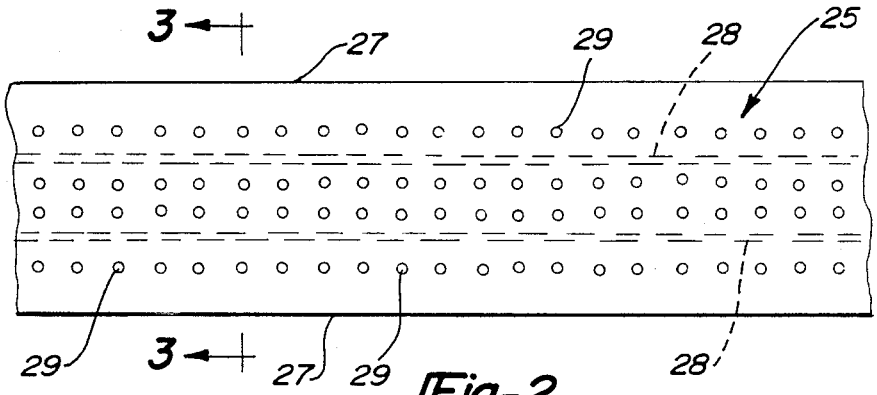
FIG. 2 is a cutaway plan view of a gutter drain strip embodying the construction of the present invention.
Figure 3:
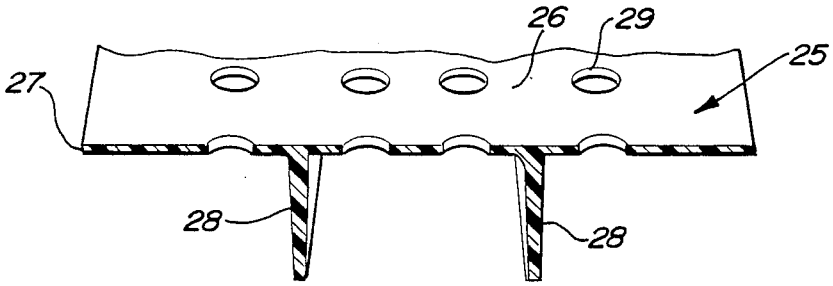
FIG. 3 is a sectional view, taken in the direction of the arrows, along the section line 3—3 of FIG. 2.
Figure 4:
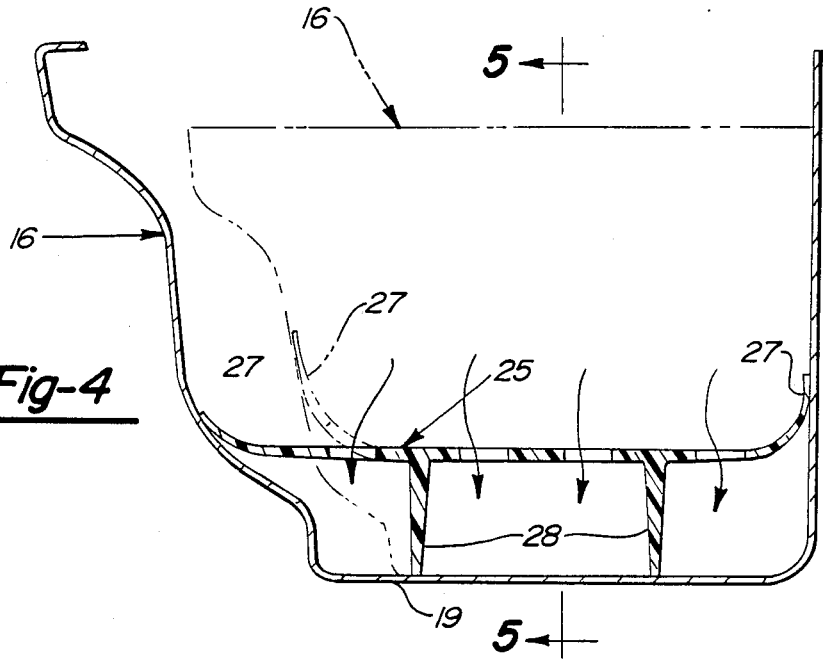
FIG. 4 is an sectional view, taken in the direction of the arrows, along the section line 4—4 of FIG. 1, showing the gutter drain strip of the present invention as it may be installed in a common gutter.

Referring now to FIG. 1, there is shown the conventional asphalt shigle roof 15, adjacent the end of which is mounted a conventional gutter, generally designated by the numeral 16, having a front wall 17, a rear wall 18, a bottom wall 19 and at least one end wall 20. The gutter 16 is held up in the conventional fashion by having gutter nails 21 pass through spacers 22 into the facia board 23. As can be seen in FIG. 4, my invention can be used with the small 4" gutters shown in phantom lines, or the larger 5" gutter, or any practicable size gutter. It should be understood that, although for ease of illustration, I have illustrated my invention in connection with a typical residential roof, my invention can also be used in gutters used in commercial and industrial roofing.

Referring now to FIGS. 2 through 6, it can be seen that the gutter drain strip 25, which fits into the gutter 16, includes an elevated platform portion 26 supported above the bottom wall 19 of the gutter 16 by a pair of downwardly depending legs 28. The height of the legs may be chosen to form the optimum drain channel under the platform portion 26.

Figure 5:
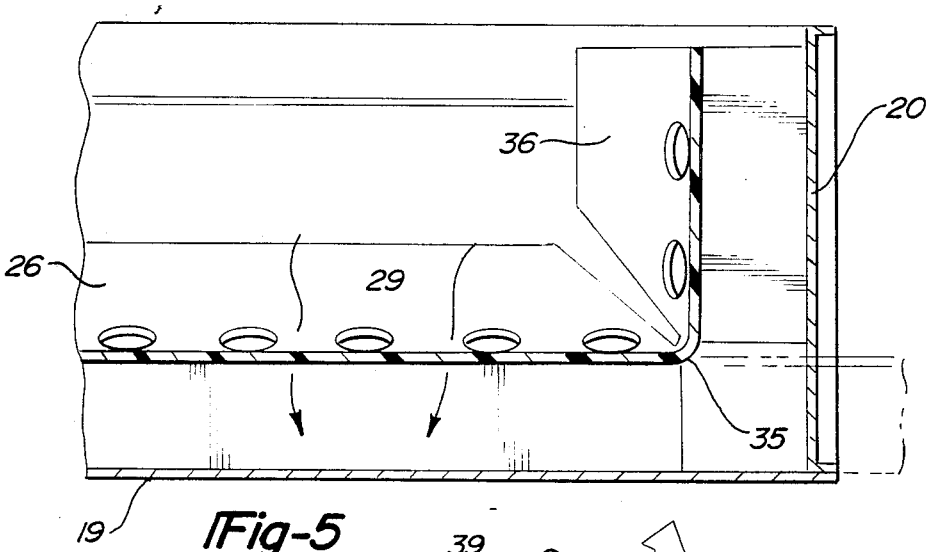
FIG. 5 is an sectional view taken in the direction of the arrows, along the section line 4—4 of FIG. 5, showing the gutter drain strip of FIG. 4 installed near an end wall of the gutter to show the right angle portion of the gutter drain strip.
Figure 6:
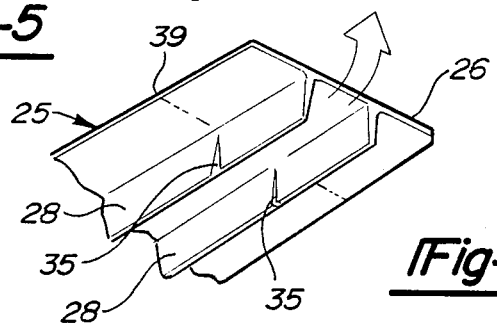
FIG. 6 is a bottom perspective view, showing how the leg portions of the gutter drain strip may be severed, and the severed portion of the gutter drain strip bent up at a right angle to provide said right angle portion.

The distal ends 27 of the platform portion 26 may be tapered to make them more flexible, if desired, so they may fit against the front and rear wall of the gutter, as shown in FIG. 1. Also, they may be formed with curvilinear portions during the manufacturing process. The legs 28 are preferably, but not necessarily, parallel to each other, and may be tapered if desired. The legs 28 are severed, as shown in FIGS. 5 and 6 at 35, and the severed portion is bent upwardly in a right angle fashion to form the right angle portion 36, which fits against the end wall 20 of the gutter 16, and provides for convenient flushing of the gutter 16 by providing for insertion of a hose nozzle between the legs 28 on the right angle portion 36 of the gutter drain strip and the end wall 20 of the gutter 16. It should be understood that the gutter drain strip 25 may be permanently mounted in the gutter 16 if desired, either during manufacture, or after installation thereof. If the drain strip 25 is permanently mounted, in addition to providing for flushing by the garden hose, it is contemplated that compressed air could be forced underneath the platform portion 26 through the right angle portion 36 of the gutter drain strip, blowing fine debris up out of the drain holes 29 and out of the gutter 16.

As can be understood, the point of severence 35 between the gutter drain strip 25 and its right angle portion 36 can be formed during installation, by the installer, as with a pair of tin snips or the like, or could be performed during the manufacturing process, such as by molding, cutting, etc. The bending of the severed portion of the gutter drain strip at the point of severence 35 may be aided by providing a living hinge or the like along the bending line 39 as shown in FIG. 6. A section of the platform portion may also have to be cut away, as shown in FIG. 5, for proper installation.

It should be understood that if the unique features of my combination gutter draining and flushing system are not desired by the consumer, the gutter drain strip itself may simply be used in the bottom of the gutter to great advantage.

Thus, by carefully analyzing the requirements for maintaining gutters in a debris-free condition, and noting what problems are still present in the art, I have dissolved a novel gutter drain strip and gutter draining and flushing system which has solved those long standing problems in the art with a novel construction which is easy to manufacture and install.

I claim:

1. A gutter drain strip including:

(a) a platform portion having distal portions;

(b) a plurality of drain holes provided in said platform portion; and (c) a pair of legs integral with and downwardly depending from said platform portion, and being of a length such that said platform portion is positioned within said gutter and located a distance spaced from the top of said gutter.

2. The device defined in claim 1, wherein said distal portions of said platform portion are tapered.

3. The device defined in claim 2, wherein said legs are tapered.

4. The device defined in claim 3, wherein said legs are parallel.

5. The device defined in claim 1, wherein said distal portion of said platform is flexible.

6. The device defined in claim 1, wherein said distal portion of siad platform is curvilinear.

7. The device defined in claim 1, wherein said distal portion of said platform is performed and is curvilinear.

8. A gutter flushing and draining system including, in combination:

(a) a gutter having a front wall, a rear wall, a bottom wall, and at least one end wall; and (b) a gutter drain strip, including:

(i) a platform portion, (ii) a plurality of drain holes provided in said platform portion, (iii) a pair of legs integral with and downwardly depending from said platform portion, said legs being of a length such that said platform portion is contained within said gutter and located a distance spaced from the top guter, with said legs being in contact with the bottom wall of said gutter and said distal portions being in contact with said front and rear walls of said gutter.

9. The system defined in claim 8, wherein:

(a) said leg portions are at least partially severed at a predetermined position proximate one end of said gutter drain strip, thereby permitting said gutter drain strip to be bent at said severed portion to form a right angle portion, and (b) said right angle portion being adjacent an end wall of said gutter to form a portion of said gutter drain strip.

10. The system defined in claim 8 wherein said distal portion of said platform portion is flexible and fits concavely between said front wall and said rear wall of said gutter when said gutter drain strip is installed.

11. The system defined in claim 8, wherein said distal portion is tapered.

12. The system defined in claim 8, wherein said distal portion is curvilinear.

13. The system defined in claim 12, wherein said legs are tapered.

14. The system defined in claim 13, wherein said legs are parallel.

15. The device defined in claim 8, wherein said distal portion of said platform is curvilinear.

16. The device defined in claim 8, wherein said distal portion of said platform portion is preformed and is curvilinear.

* * * * *

UNITED STATES PATENT AND TRADEMARK OFFICE

CERTIFICATE OF CORRECTION

PATENT NO. : 4,964,247

DATED : October 23, 1990

INVENTOR(S) : JOSEPH P SPICA

It is certified that error appears in the above—identified patent and that said Letters Patent is hereby corrected as shown below:

Col. 4, line 33, delete "siad" and insert --said--.

Col. 4, line 35, delete "performed" and insert --preformed--.

Col. 4, line 48, delete "guter" and insert --gutter--.

Signed and Sealed this

Twenty-fourth Day of November, 1992

*Attest:*

DOUGLAS B. COMER

*Attesting Officer*

*Acting Commissioner of Patents and Trademarks*